US005579094A

United States Patent [19]

Behe et al.

[11] Patent Number: 5,579,094

[45] Date of Patent: Nov. 26, 1996

[54] FILAMENT FIBER DEVELOPMENT TRAPS

[75] Inventors: Thomas J. Behe, Webster; Samuel P. Mordenga, Rochester, both of N.Y.

[73] Assignee: Xerox Corporation, Stamford, Conn.

[21] Appl. No.: 320,723

[22] Filed: Oct. 11, 1994

[51] Int. Cl.[6] ..... G03G 21/00

[52] U.S. Cl. ..... 355/215; 209/615; 355/245

[58] Field of Search ..... 355/30, 215, 245; 209/300, 615

[56] References Cited

U.S. PATENT DOCUMENTS

| | | | |
|---|---|---|---|
| 4,054,381 | 10/1977 | Bernhard | 355/302 |
| 4,319,832 | 3/1982 | Sakamoto et al. | 355/303 |
| 4,360,944 | 11/1982 | Iwai et al. | 118/652 X |
| 4,389,968 | 6/1983 | Satomura | 118/652 |
| 4,561,759 | 12/1985 | Knott | 355/245 |
| 4,752,805 | 6/1988 | Fukae et al. | 355/298 |
| 5,153,642 | 10/1992 | Folkins et al. | 355/215 |
| 5,200,788 | 4/1993 | Thayer | 355/298 |
| 5,502,549 | 3/1996 | Hart et al. | 355/245 |

*Primary Examiner*—Arthur T. Grimley
*Assistant Examiner*—Sophia S. Chen
*Attorney, Agent, or Firm*—John S. Wagley

[57] ABSTRACT

A developer unit adapted to develop with marking particles a latent image. The developer unit includes a housing and a mover for moving the marking particles in a recirculating path within the housing. The developer unit further includes a fibrous element located adjacent the recirculating path to trap contaminants recirculated by the mover with the marking particles.

20 Claims, 3 Drawing Sheets

FILAMENT FIBER DEVELOPMENT TRAPS

The present invention relates to a developer apparatus for electrophotographic printing. More specifically, the invention relates to a trap for catching contamination in a developer apparatus.

Cross reference is made to the following applications filed concurrently herewith: U.S. application Ser. No. 08/321,633, filed Oct. 11, 1994 entitled "Electrically Biased Toner Filtration", by S. C. Hart et al. now U.S. Pat. No. 5,502,549, issued Mar. 26, 1996 and U.S. application Ser. No. 08/321,632, filed Oct. 11, 1994, entitled "Point of Use Toner Filtration ", by S. C. Hart et al.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image.

In an electrophotographic printer as the developer material is transferred to the photoreceptor and eventually to the copy paper, this used toner must be replaced. The electrophotographic printer thus includes a device for replenishing toner from which fresh toner is dispensed into the machine. In earlier copy machines and printers, toner used in the developer unit was replenished by pouring loose toner into a toner container. In using this replenishing method at least two major problems occurred. The first problem was that a portion of the loose toner would either be spilled during filling or the loose toner would form a cloud when filling and settle later. In either case the spilled or settled toner would contaminate the machine or printer and require an expensive service call. The second problem was that contamination would enter the toner container during fill and negatively effect the operation of the machine.

In more recent copy machines and printers, toner used in the developer unit is replenished by exchanging an empty toner resupply cartridge with a new, full cartridge. Many devices have been used to seal the cartridge prior to installation in the machine. These devices and others have been used to maintain the sealed integrity of the copy cartridge during the exchange of an empty cartridge for a full cartridge. The use of cartridges has reduced the problems with spilled and settled toner as well as contamination problems during toner replenishing. To provide for a small compact toner cartridge and to provide for a toner cartridge in which the opening to the cartridge may be easily removed, the toner cartridge typically has a compact shape with a small opening from which the toner is dispensed. While the use of cartridges for the storage and refilling of toner within a machine reduces the contamination encountered during filling, even in the most stringently controlled manufacturing environments, contaminants may enter the toner itself during its manufacture and/or could enter the cartridge during its manufacture and/or during filling at the factory and later progress into the developer housing causing copy quality problems. Furthermore the developer housing and other components in the development system may collect contaminants during their manufacture and further contribute contamination to the development system.

The development system, the area of the electrophotographic printer where the developer material is transferred to the photoreceptor, typically includes a wide area extending across the full width of the photoreceptor in order that a full image width may be developed. The toner must thus progress from the toner container into the developer housing and progress along the full width of the developer housing in order that the full width of the latent image may be developed. Furthermore, in attempts to make inexpensive and compact electrophotographic printers and to minimize space and related costs, the location of the toner cartridge and the developer housing may be far apart.

If the contamination, particularly in the form of clothing and paper fibers, reaches the developer housing, copy quality and machine reliability suffer. Toner particles also have a tendency to adhere together into large scale clumps which ride on the top of the developer material in the developer housing negatively effecting the blending and admixing of the incoming toner.

The use of smaller carrier and toner particles, which are typical when using colored toners for color electrophotography compounds problems associated with contamination. Imperfections in color copies, such as those caused by contamination, are much more noticeable to the human eye than imperfections in monochromic copies.

The presence of contamination in development systems utilizing hybrid scavengeless development is particularly a concern. The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or U.S. Pat. No. 5,063,875 to Folkins et al. U.S. Pat. No. 4,868,600 is incorporated herein by reference. In a scavengeless development system, toner is detached from the donor roll by applying an AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography. The small color toner and related carrier particles used for the implementation of these devices and the greater visual scrutiny given to color copies compound contamination problems. Furthermore, the electrode wires utilized to form the toner powder cloud are particularly susceptible to contamination in general and in particular, to fibers such as clothing and paper fibers.

The following disclosures may be relevant to various aspects of the present invention:

U.S. Pat No. 5,200,788

Patentee: Thayer

Issue Date: Apr. 6, 1993

U.S. Pat No. 4,752,805

Patentee: Fukae et al.

Issue Date: Jun. 21, 1988

U.S. Pat No. 4,561,759

Patentee: Knott

Issue Date: Dec. 31, 1985

U.S. Pat No. 4,389,968

Patentee: Satomura

Issue Date: Jun. 28, 1983

U.S. Pat No. 4,360,944

Patentee: Iwai et al.

Issue Date: Nov. 30, 1982

U.S. Pat No. 4,319,832

Patentee: Sakamoto et al.

Issue Date: Mar. 16, 1982

U.S. Pat No. 4,054,381

Patentee: Bernhard

Issue Date: Oct. 18, 1977

Ser. No. 08/181,146

Applicant: Edmunds et al.

Date Filed: Jan. 12, 1994,

The relevant portions of the foregoing disclosures may be briefly summarized as follows:

U.S. Pat No. 5,200,788 discloses a brush auger reclaim filtration assembly incorporated into an open ended chamber. The brush auger is a toner reclaim filtration device that is rotatably mounted, in the chamber, to move toner and debris along a separating screen. Also contained in the housing is a mounted transport auger that rotates as it moves the reclaimed toner to the development housing.

U.S. Pat No. 4,752,805 discloses a device for recycling residual developer particles which are removed from a photoconductive element by a cleaning unit in an electrographic copier or printer. The device comprises a first tube connected to the cleaning unit and a second tube which is connected to the first tube and leads to the developer unit. The second tube is disposed along the developer unit. The residual particles are transferred from the cleaning device through the first tube and into the second tube. The second tube is provided with holes spaced at predetermined distances from each other. The residual particles fall through those holes and co-mingle with developer material stored in the developer unit. A second auger is disposed within the second tube to move the residual particles to the first tube.

U.S. Pat No. 4,561,759 discloses a device for filling and filtering toner from a supply container which is placed by an operator in communication with a feed container in a photocopier. The device has a cylindrical filling opening for the feed container with a cross section such that the supply container can be inverted. The device has a filter basket disposed in the region of the filling opening which is closed from the feed container by a filter mesh. An electric vibrator is connected to the device.

U.S. Pat No. 4,389,968 discloses a toner regenerating device with a mesh disposed in the route of the toner collected from an image bearing member. The device includes an apparatus for imparting to the collected toner through the mesh a force causing the collected toner to move along the mesh. The collected toner on the mesh containing foreign material and solidified toner is loosened so that the solidified toner is divided into fine particles. The foreign matter is caused to float up over the collected toner and prevented from passing through the mesh.

U.S. Pat No. 4,389,968 discloses a toner transporting device for an electrophotographic copying apparatus. The device includes a transporter for carrying toner to and into a chamber through a first opening. Toner in the chamber is moved out of a second opening. An elastic plate is mounted at one of its ends for rotation within the chamber such that its opposite tip end is maintained in contact with the interior wall of the chamber except at the second chamber opening.

U.S. Pat No. 4,319,832 discloses a cylindrical electrode disposed in a tubular housing and applied with an electric potential opposite in polarity to a charge on usable toner particles removed from the photoconductive drum. A fur brush functions to remove the toner and foreign matter from the drum and to create an air flow which carries the toner and foreign matter through a passageway defined between the housing and cylinder. The foreign matter is carried into a foreign matter chamber by centrifugal force while the toner adheres to the cylinder which is rotated in the same direction as the air flow. The toner is carried past a blade which extends closely adjacent to the cylinder into a toner recovery chamber from which it is scrapingly removed from the cylinder and recycled.

U.S. Pat No. 4,054,381 discloses a toner filter arrangement adapted for use in a cleaning station of a xerographic reproduction machine. Foreign material and other contaminants are removed from residual toner prior to its collection in a disposable or reuse container or return to the developer station. The filter arrangement comprises a housing having an input opening through which removed toner enters and an output opening through which filtered toner exits. The housing includes a spiral brush mounted for rotation on a shaft centrally located within the housing and a stationary open mesh screen coaxially located with respect to the shaft. Rotation of the brush operates to sift toner through the screen to the outlet of the filter housing.

Co-pending application Ser. No. 08/181,146 filed Jan. 12, 1994, discloses a conveyor for transporting marking particles within a developer unit. The conveyor comprises a conduit and an elongated member mounted rotatably in the conduit. The elongated member includes a plurality of pliant elements extending outwardly therefrom in an at least partially spiral pattern and closely conforming to the conduit.

SUMMARY OF THE INVENTION

According to the present invention, there is provided a developer unit adapted to develop with marking particles a latent image. The developer unit includes a housing and a mover for moving the marking particles in a recirculating path within the housing. The developer unit further includes a fibrous element located adjacent the recirculating path to trap contaminants recirculated by the mover with the marking particles.

According to the present invention there is further provided a printing machine of the type having a developer unit adapted to develop a latent image with marking particles. The developer unit includes a housing and a mover for moving the marking particles in a recirculating path within the housing. The developer unit further includes a fibrous element located adjacent the recirculating path to trap contaminants recirculated by the mover with the marking particles.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
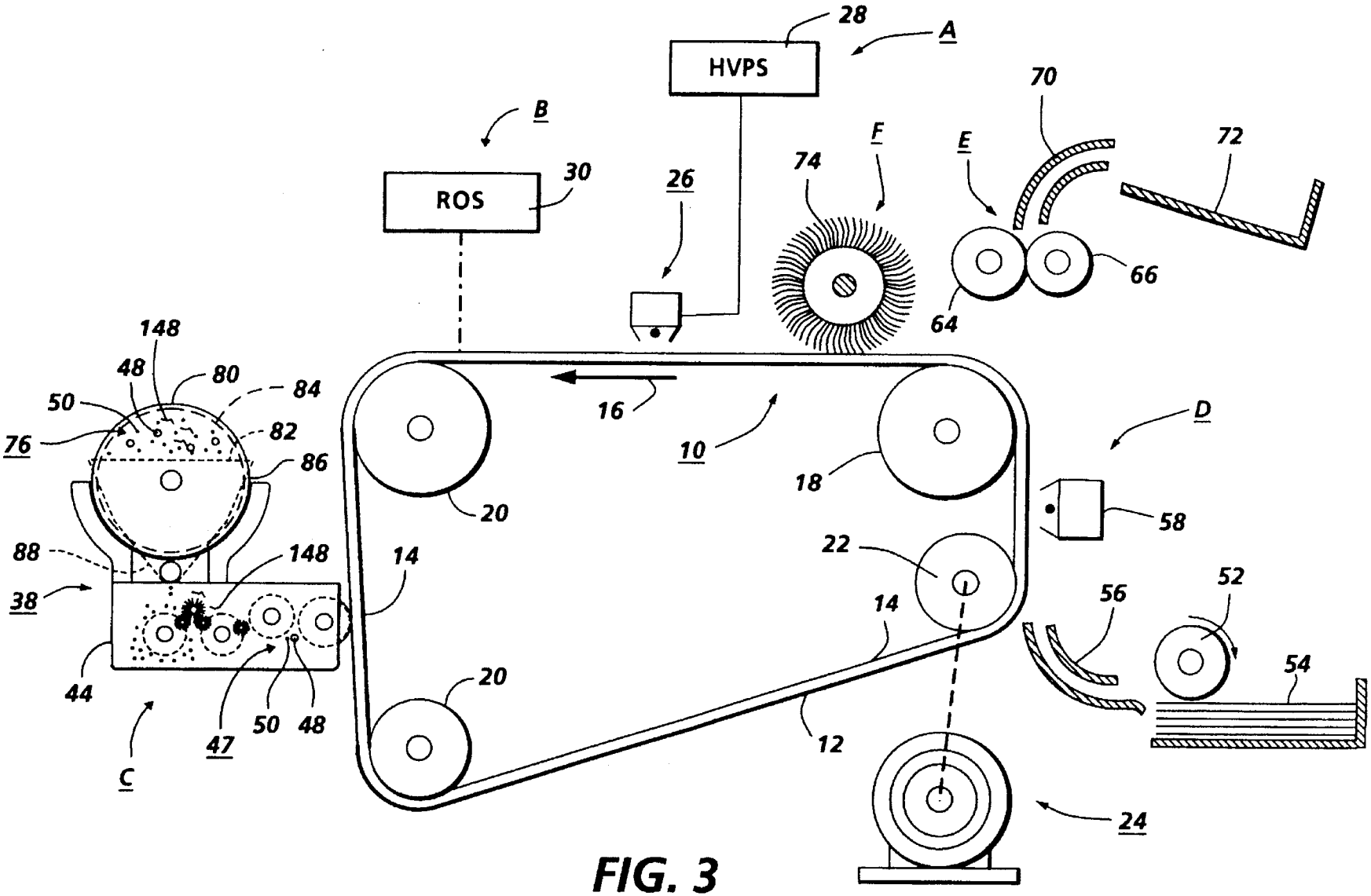
FIG. 3 is a schematic elevational view of an illustrative electrophotographic printing machine incorporating the filament fiber trap of the development apparatus of the present invention therein.

Referring initially to FIG. 3, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably, the surface 12 is made from a selenium alloy or a suitable photosensitive organic compound. The substrate 14 is preferably made from a polyester film such as Mylar® (a trademark of Dupont (UK) Ltd.) a polyester file, which has been coated with a thin layer of aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, electrical potential. A high voltage power supply 28 is coupled to device 26.

Next, the charged portion of photoconductive surface 12 is advanced through exposure station B. At exposure station B, the ROS 30 lays out the image in a series of horizontal scan lines with each line having a specified number of pixels per inch. The ROS includes a laser and a rotating polygon mirror block associated therewith. The ROS exposes the charged photoconductive surface of the printer.

After the electrostatic latent image has been recorded on photoconductive surface 12, the motion of the belt 10 advances the latent image to development station C as shown in FIG. 3. At development station C, a development system 38, develops the latent image recorded on the photoconductive surface. The chamber in developer housing 44 stores a supply of developer material 47. The developer material 47 may be, as shown in FIG. 3, a two component developer material of at least magnetic carrier granules 48 having toner particles 50 adhering triboelectrically thereto. It should be appreciated that the developer material may likewise comprise a one component developer material consisting primarily of toner particles.

Again referring to FIG. 3, after the electrostatic latent image has been developed, the motion of the belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual developer material adhering to photoconductive surface 12 is removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Referring again to FIG. 3, in order to provide a constant supply of at least toner 50 to replace that consumed in the developing of the latent image, the development system 38 includes a cartridge 80 for storing a replaceable supply of replenisher 76 including at least toner 50. The replenisher 76 may contain carrier granules 48 as well as toner particles 50 in order to replace worn and broken carrier granules 48 as shown in FIG. 3. It should be appreciated however that the invention may be practiced with the replenisher including only toner. As the typical usage of toner is larger than the typical usage of carrier granules (on a weight basis) whether on a per copy or per hour basis, the ratio of toner to carrier in the cartridge is much larger than the ratio of toner to carrier in the housing. The use of replenisher containing carrier particles as well as toner is disclosed in U.S. Pat. No. 4,614,165 to Folkins et al. herein incorporated by reference. The cartridge 80 is a replaceable item that can be made of any suitable durable material and may be vertically oriented with its opening pointed downward whereby it may be emptied by gravity. Where, however, space constraints become a problem, the cartridge 80 may include a device (not shown) for extracting the developer material from the cartridge 80. Particles in the toner cartridge 80 progress to a toner sump or developer sump 82 as shown in FIG. 3. While the sump 82 may ideally be located above the development housing 44 whereby gravity may feed the replenisher 76 from the sump 82, where, as earlier stated, space constraints for the toner cartridge 80, sump 82, and developer housing 44 become a concern, the sump 82 may not be located above the development housing 44.

Figure 1:
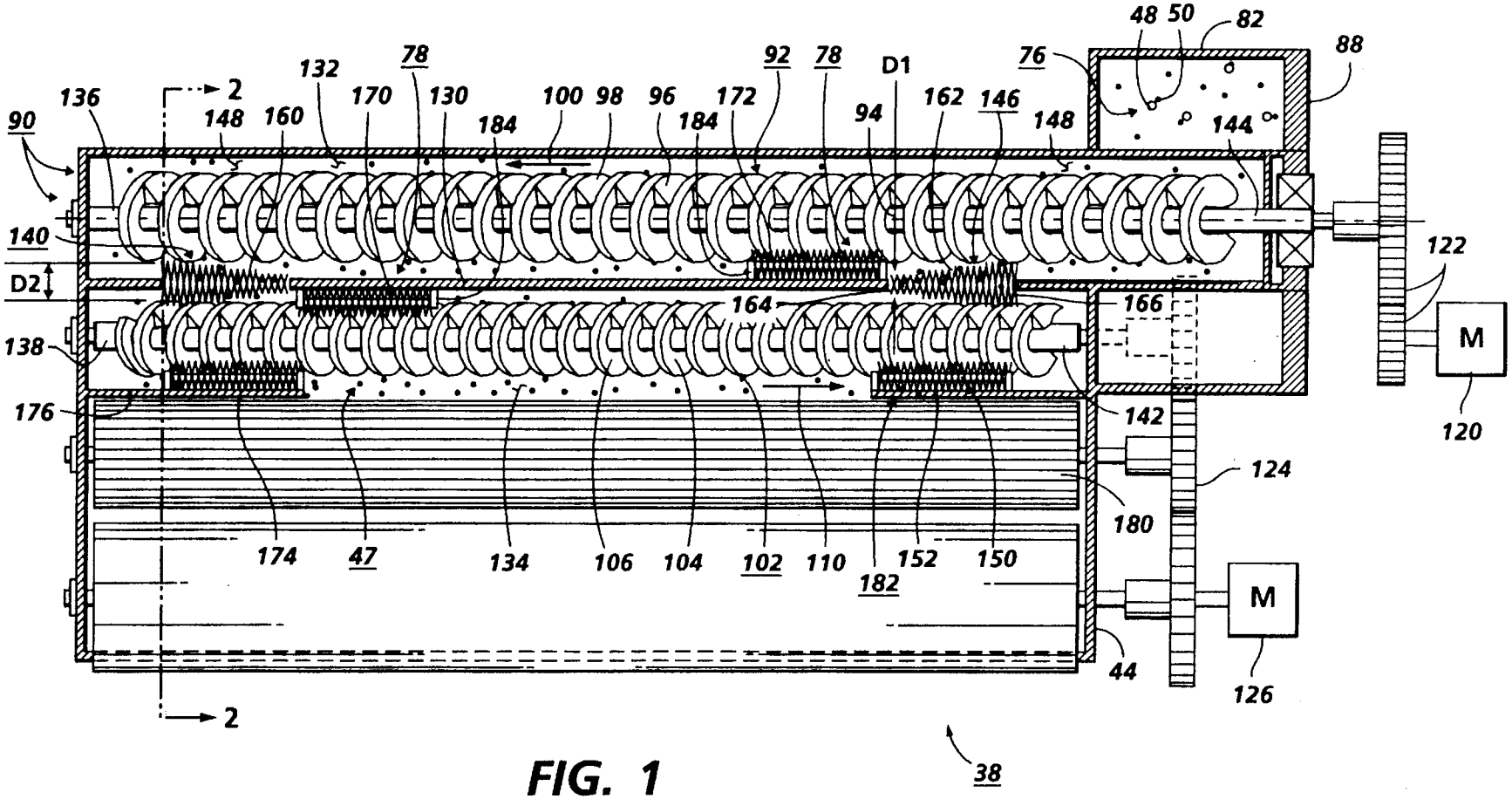
FIG. 1 is a plan view of a development housing partially in section including a filament fiber trap according to the present invention.

Referring now to FIG. 1, according to the present invention, filament fiber trap 78 is shown as part of the development system 38. It should be appreciated that the filament fiber trap 78 is adaptable to development system utilizing toner or developer. The development system 38 shown in FIG. 1 represents a typical development system for providing toner from the toner cartridge 80 to the latent image 10 (see FIG. 3).

It should also be appreciated that the copy machine may also include a cleaning system (not shown) as a part of the cleaning station F (see FIG. 3) in which toner not used in the development process may be recycled for use in the developer system 38. It should also be appreciated that the toner supplied by the cleaning system may likewise be filtered in the filament fiber developer trap 78.

Referring again to FIG. 1, the development system 38 includes the developer housing 44 which supports the remainder of the development system 38. The sump 82 is located above and near a first end 83 of the developer housing 44. The sump 82 receives replenisher 76 from the toner cartridge 80 (see FIG. 3) and stores a supply of the replenisher 76 for later delivery to the developer housing 44. The developer housing 44 also supports the toner or developer cartridge 80. The toner cartridge 80 preferably is a cylindrical cartridge with a spiral rim 84 formed therein. It should be appreciated, however, that the cartridge 80 may likewise be vertically located whereby gravity is used to urge the replenisher 76 toward the developer housing 44. The cartridge 80 is rotated about supports (not shown) by means of a motor (not shown).

The sump 82 has a V-shaped cross section with a wide upper portion 86 and a narrow lower portion 88 (see FIG. 3).

Referring now to FIG. 1, according to the present invention, a mixer 90 is used to circulate the developer material 47 in the developer housing 44. The mixer 90 serves to mix the replenisher 76 which has entered the developer housing 44 from the sump 82 with the developer material 47 to assure that the carrier granules 48 in the developer 47 mix with the toner particles 50 in the replenisher 76. The mixer 90 may have any suitable form such as a stirrer having right hand and left hand spiral portions or having oppositely oriented paddles for urging the developer to the right and to the left.

Alternatively, as in FIG. 1, the mixer 90 includes a first mixing auger 92. The first auger 92 has a centrally located body 94 in the form of a shaft from which extends a spiral axially extending web 96. The spirally extending web 96 has a first orientation 98 to urge the developer material 47 in a first direction 100. 5paced from and parallel to the first auger 92 is a second mixing auger 102 which has a structure similar to the first auger 92, except web 104 of the second auger 102 has a second orientation 106 opposite the first orientation 98 to urge the developer material 47 around the second auger 102 in a second direction 110 opposite the first direction 100. Preferably, as shown in FIG. 1, the first mixing auger 92 extends into the toner sum p 82 to draw replenisher 76 from the sump 82.

Referring again to FIG. 1, the mixing augers 92 and 102 may be powered by any suitable power source such as by electrical motors. For example the first auger 92 may be directly connected at the body 94 of the auger 92 to a motor, or as shown in FIG. 1, include first gears 122 located between the first auger 92 and a first auger motor 120 to obtain the proper rotational speed of the first auger 92. The second auger 102 may be powered by the first motor 120 through intermediate shafts and gears or, as shown in FIG. 1, the second auger 102 may include second gears 124 located between the second auger 102 and a second auger motor 126 to obtain the proper rotational speed of the second auger 102.

The mixing augers 92 and 102 may be located in a hollow developer housing, but, preferably, to improve the mixing of the developer 47 within the housing 44, the housing includes a wall 130 located between the first and second mixing augers 92 and 102, respectively, to provide first and second mixing channels 132 and 134, respectively, for the first and second mixing augers 92 and 102, respectively. To permit transfer of developer 47 from the first channel 132 near exit end 136 of the first mixing auger 92 to the second channel 134 near entrance end 138 of the second mixing auger 102, a first opening or port 140 is located in the wall 130. Likewise, to permit transfer of developer 47 from the second channel 134 near exit end 142 of the second mixing auger 102 to the first channel 132 near entrance end 144 of the first mixing auger 92, a second opening or port 146 is located in the wall 130.

Replenisher material 76 enters the developer housing 44 from the sump 82 near entrance end 144 of the first mixing auger 92 and mixes with developer material 47 already in the housing 44. The developer material 47 is moved along the first channel 132 by the first auger 92 to the exit end 136 of the first mixing auger 92. At the exit end 136, the developer material 47 passes through the first port 140 and enters the second channel 134 near the entrance end 138 of the second mixing auger 102. The developer material 47 is moved along the second channel 134 by the second auger 102 to the exit end 142 of the second mixing auger 102, thereby circulating the developer material 47. Contamination 148 typically in the form of paper or clothing fibers are mixed with the developer material 47 in the mixer 90 and likewise flow through the mixer 90.

Referring again to FIG. 1, the filament fiber trap 78 is located within the developer housing 44. The trap 78 may be any suitable form sufficient to trap the fibers 148 Preferably the trap 78 includes a body 150 from which filaments 152 extend. The filaments 152 serve to catch and trap the fibers 148 in the developer material 47 as the developer material 47 circulates through the mixer 90. The body 150 may be made of any suitable material such as a metal, for example steel. The filaments 152 may be made of any suitable material and may be pliant or stiff. The filaments 152 may be made of a pliant material such as Nylon® (a trademark of DuPont (UK) Ltd.)(a polyamide), polyethylene, polypropylene, or any plastic that does not melt or interact with the developer material 47 and is able to withstand wear caused by contact with the channels 132 and 134.

Figure 2:
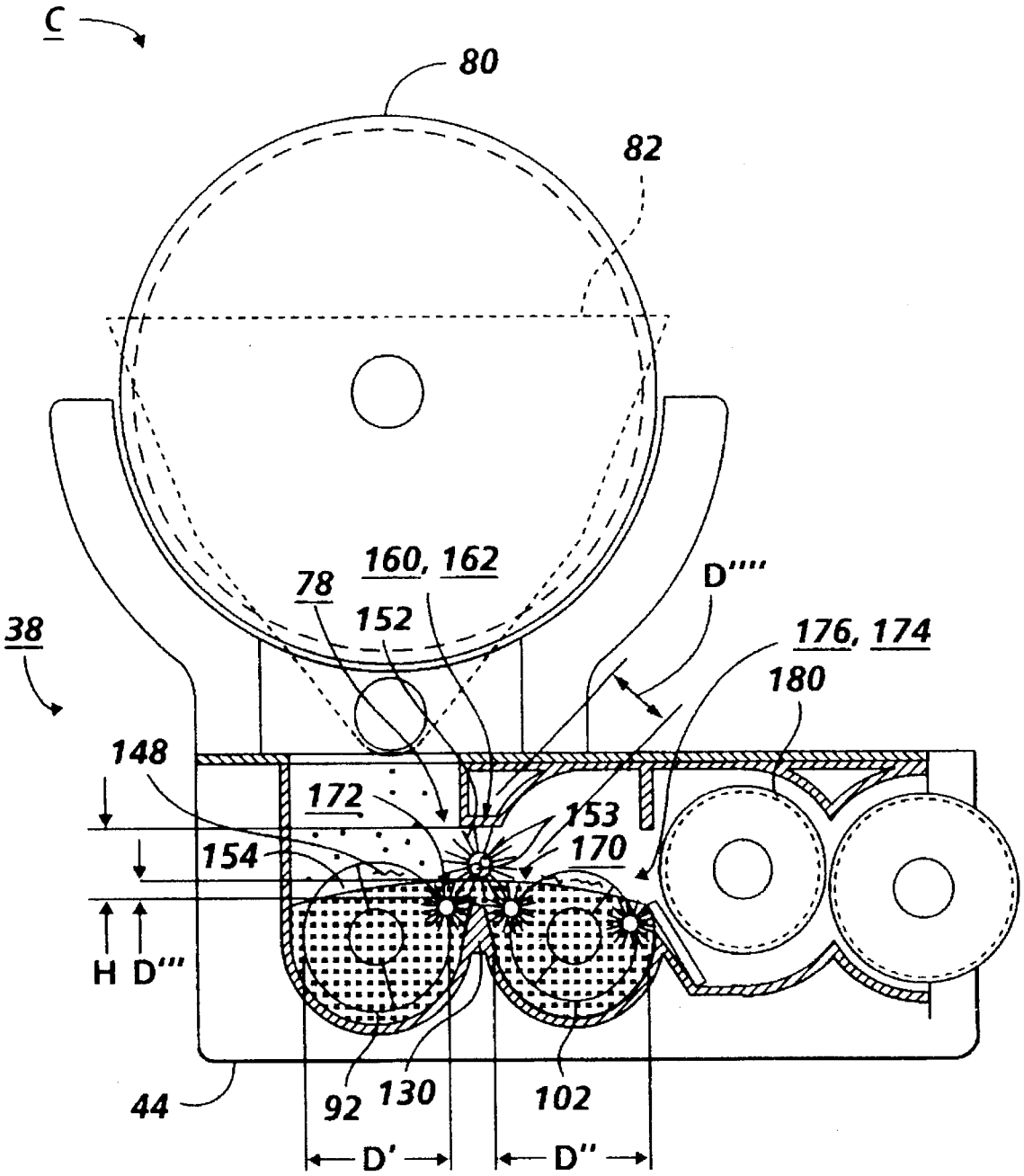
FIG. 2 is a partial sectional view through section 2—2 of FIG. 1.

The filaments 152 may be secured to the body 150 in any suitable fashion such as by gluing them to the body 150, but preferably the body is flexible and comprises a pair of wires 153 which are twisted in a helical fashion with the filaments 152 entrapped therebetween as shown in FIGS. 1 and 2.

Preferably, however, the filaments 152 are stiff and are made of a material that does not melt or interact with the developer material 47 and is able to withstand wear caused by contact with the channels 132 and 134 such as steel.

The traps may preferably be commercially available brushers.

Now referring to FIGS. 1 and 2 since the fibers 148 are typically less dense than the developer material 47, most of the fibers 148 float to surface 154 of the developer material 47 in the developer housing 44. The traps 78 are preferably located at least partially extending above the surface 154 to more effectively trap the fibers 148. Preferably, the filaments 152 extend a depth D''' below the surface 154 of approximately 25% height H of the trap 78. While the relative size of the traps 78 is not critical, the traps have been found effective with a diameter D'''' of approximately one-half the diameter D' of the augers 92 and 102.

Referring again to FIG. 1, since the developer material is circulated through the ports 140 and 146, the ports 140 and 146 provide a particularly effective location for the traps 78.

Referring again to FIGS. 1 and 2, to adequately provide for the translation of developer material 47 through the mixer 90, the channels 132 and 134 have an arcuate cross section at least in the lower portion of the channels 132 and 134. The bottom of the channels 132 and 134 is defined by a diameter D" which is slightly larger than the diameter D' of the augers 92 and 102.

While the invention may be practiced with a singular trap 78, preferably a plurality of traps are located within the mixer 90. For example, referring to FIG. 1, the developer system 38 includes a first port trap 160 and a second port trap 162 located in the first port 140 and the second port 146, respectively.

While the traps 78 may have any effective shape the shape of the first port trap 160 and the second port trap 162 is preferably generally frustoconical with a first end diameter D1 approximately one half as large as a second end diameter D2. Smaller first ends 164 are located inwardly of the housing 44 and larger second ends 166 are located outwardly of the housing 44.

In addition to the traps 160 and 162 in the ports 140 and 146, respectively, the developer system may preferably include additional traps. Areas in and around the mixer 90 where a slight flow of developer occurs are particularly good locations for additional traps. For example, referring to FIGS. 1–3, first port internal trap 170 is located near the first port 140 adjacent the wall 130 and inwardly from the port 140 where developer material flow is minimal. Second port internal trap 172 is located near the second port 146 adjacent the wall 130 and inwardly from the port 146 where developer material flow is likewise minimal. First port external trap 174 is located near a second wall 176 which separates the mixer 90 from transport roller 180. The first port external trap 174 is located relatively near and inwardly from the port 140 also at a location where developer material flow is minimal. Second port external trap 182 is located relatively near the second port 146 adjacent the second wall 176 and aligned with from the port 146 where developer material flow is likewise minimal.

The traps 78 may be secured in the developer station C by any suitable method. For example, the traps 78 may be glued to the housing 44, secured between an upper half (not shown) of the developer housing and a lower half (not shown) of the developer housing, or as shown in FIG. 1, snapped to tabs 184 extending from the housing 44.

It should be appreciated that the augers 92 and 102 may be constructed alternatively of spiral pliant bristles rather than the webs 96. If the augers are made of pliant bristles the channels may be closely conforming to the augers or be in slight interference therewith.

As the fibers 148 circulate through the mixer 90, the traps 78 serve to catch the fibers. Also the traps 78, and the first port trap 160 and the second port trap 162 in particular serve to break up agglomerates which form in the sump 82 and in the developer housing 44.

It should be further appreciated that the filament fiber trap 78 may be located elsewhere in the machine such as in the waste toner system (not shown) for filtering waste toner or be used to filter toner or replenisher during the manufacture thereof.

The use of a filament fiber brush efficiently removes cloth fibers and paper fibers which negatively affect image quality and machine reliability.

The use of a filament fiber brush serves to break up large scale clumps of developer material which may enter the developer housing and negatively affect the blending and admixing of the toner.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A developer unit adapted to develop with marking particles a latent image, comprising:

a housing;

a first member located at least partially with said housing for moving the marking particles in a first direction;

a second member located at least partially with said housing for moving the marking particles in a second direction opposed to the first direction, said first member and said second member cooperating to move the marking particles in a recirculating path within said housing; and a fibrous element located adjacent the recirculating path to trap contaminants recirculated by said first member and said second member within the marking particles.

2. A developer unit according to claim 1, wherein said element is positioned at least partially within the recirculating path.

3. A developer unit according to claim 1, wherein said element comprises:

a body; and a plurality of fibrous members extending therefrom.

4. A developer unit according to claim 1, wherein said fibrous element comprises a plurality of fibrous elements with each of said plurality of fibrous elements being spaced from one another.

5. A developer unit adapted to develop with marking particles a latent image, comprising:

a housing;

means for moving the marking particles in a recirculating path within said housing; and a fibrous element located adjacent the recirculating path to trap contaminants recirculated by said moving means within the marking particles, said element including a core and bristles extending from said core.

6. A developer unit according to claim 5, wherein said bristles comprise pliant bristles.

7. A developer unit according to claim 5, wherein said bristles comprise wires.

8. A developer unit adapted to develop with marking particles a latent image, comprising:

a housing;

a first auger for translating the marking particles in a first direction, from a first end to a second end thereof;

a second auger for translating the marking particles in a second direction opposite to the first direction, from the second end to the first end, said second auger being spaced from and parallel to said first auger, said housing defining a first aperture proximate said second end for passage of the marking particles from said first auger to said second auger and a second aperture proximate the first end for passage of the marking particles from said second auger to said first auger; and a fibrous element located adjacent the recirculating path to trap contaminants within the marking particles recirculated by said first auger and said second auger.

9. A developer unit according to claim 8, wherein said element is positioned adjacent the first aperture.

10. A developer unit according to claim 8, wherein said element is positioned adjacent the second aperture.

11. A printing machine of the type having a developer unit adapted to develop a latent image with marking particles, comprising:

a housing;

a first member located at least partially with said housing for moving the marking particles in a first direction;

a second member located at least partially with said housing for moving the marking particles in a second direction opposed to the first direction, said first member and said second member cooperating to move the marking particles in a recirculating path within said housing; and a fibrous element located adjacent the recirculating path to trap contaminants recirculated by said first member and said second member within the marking particles.

12. A printing machine according to claim 11, wherein said element is positioned at least partially within the recirculating path.

13. A printing machine according to claim 11, wherein said element comprises:

a body; and a plurality of fibrous members extending therefrom.

14. A printing machine according to claim 11, wherein said fibrous element comprises a plurality of fibrous elements with each of said plurality of fibrous elements being spaced from one another.

15. A printing machine adapted to develop with marking particles a latent image, comprising:

a housing;

means for moving the marking particles in a recirculating path within said housing; and a fibrous element located adjacent the recirculating path to trap contaminants recirculated by said moving means within the marking particles, said element including a core and bristles extending from said core.

16. A printing machine according to claim 15, wherein said bristles comprise pliant bristles.

17. A printing machine according to claim 15, wherein said bristles comprise wires.

18. A printing machine of the type having a developer unit adapted to develop to latent with marking particles, comprising:

a housing;

a first auger for translating the marking particles in a first direction, from a first end to a second end thereof;

a second auger for translating the marking particles in a second direction opposite to the first direction, from the second end to the first end, said second auger being spaced from and parallel to said first auger, said housing defining a first aperture proximate the second end for passage of the marking particles from said first auger to said second auger and a second aperture proximate said first end for passage of the marking particles from said second auger to said first auger, said first member and said second member cooperating to move the marking particles in a recirculating path within said housing; and a fibrous element located adjacent the recirculating path to trap contaminants recirculated by said moving means within the marking particles.

19. A printing machine according to claim 18, wherein said element is positioned adjacent the first aperture.

20. A printing machine according to claim 18, wherein said element is positioned adjacent the second aperture.

* * * * *